United States Patent [19]

Defrance et al.

[11] Patent Number: 4,840,514

[45] Date of Patent: Jun. 20, 1989

[54] MANHOLE ASSEMBLY WITH T-SHAPED HINGE

[75] Inventors: Andre Defrance, Pont A Mousson; Jean-Claude Hauer, Saulxures les Nancy, both of France

[73] Assignee: Pont-A-Mousson S.A., Nancy, France

[21] Appl. No.: 178,932

[22] Filed: Apr. 7, 1988

[30] Foreign Application Priority Data

Apr. 7, 1987 [FR] France ..... 87 04885
Dec. 16, 1987 [FR] France ..... 87 17571

[51] Int. Cl.[4] ..... E02D 29/14; E05D 7/10
[52] U.S. Cl. ..... 404/25; 16/260
[58] Field of Search ..... 404/25, 26; 49/463; 52/19–21; 16/254, 260, 262, 267, 268, 378, 386

[56] References Cited

U.S. PATENT DOCUMENTS

| | | | |
|---|---|---|---|
| 780,441 | 1/1905 | Von Oven | 16/254 X |
| 1,496,466 | 6/1924 | Jackson | 16/260 |
| 3,130,651 | 4/1964 | Werner | 16/267 X |
| 4,372,007 | 2/1983 | Lee | 16/254 X |
| 4,756,055 | 7/1988 | Welsch et al. | 16/260 |

FOREIGN PATENT DOCUMENTS

| | | | |
|---|---|---|---|
| 1410293 | 12/1965 | France | 404/25 |
| 38010 | 4/1936 | Netherlands | 404/26 |
| 1982 | of 1898 | United Kingdom | 404/25 |
| 18638 | of 1902 | United Kingdom | 49/463 |
| 474250 | 10/1937 | United Kingdom | 404/25 |
| 485192 | 5/1938 | United Kingdom | 404/25 |
| 572451 | 10/1945 | United Kingdom | 404/25 |
| 1471873 | 4/1977 | United Kingdom | 404/25 |
| 2102864 | 2/1983 | United Kingdom | 52/20 |

*Primary Examiner*—Stephen J. Novosad
*Assistant Examiner*—G. Spahn
*Attorney, Agent, or Firm*—Sughrue, Mion, Zinn, Macpeak & Seas

[57] ABSTRACT

A manhole assembly includes a circular cover 4 seated in a frame 1 and removably hinged thereto by a T-shaped lug 16 extending radially from the cover and lying within a matingly configured receptacle 5 defined in an upper edge of the frame. Lips 9 overhang opposite interior ends of the deepened receptacle trough 7 to restrain the pivot shaft 18 of the lug against vertical removal with the cover closed, in which position the lug has no contact with the receptacle surfaces to avoid clanking noise upon the passage of a vehicle.

12 Claims, 6 Drawing Sheets

MANHOLE ASSEMBLY WITH T-SHAPED HINGE

BACKGROUND OF THE INVENTION

This invention relates to a manhole assembly for a roadway or the like wherein a circular cover is seated within a surrounding frame and is removably hinged thereto to implement the pivotal raising and lowering of the cover.

A known manhole construction of this general type has two coaxial pivot shafts projecting laterally from one side of the cover and journalled within respective housings defined in the frame. The shafts are retained within the housings by individual stopper plates removably affixed to the frame. Such a construction requires the stopper plates as additional components, which must be detached from the frame to enable the removal of the cover.

Another known construction has profiled housings in the frame for receiving the pivot shafts and which prevents the cover from being vertically raised in the event of an internal thrust from below, such as a water surge. The profiled housings are fully open and exposed, however, wherefore dirt and debris can accumulate in them and thus hinder or even block the opening of the cover. Moreover, due to the relatively large circumferential separation between the two pivot shafts, if an off-center opening force is applied to the cover which is not equally distributed between the two shafts, the cover can tilt crosswise and become jammed or wedged. If this occurs from a water surge the cover cannot reclose itself under its own weight, which presents a hazard for automobiles and pedestrians.

A construction is also known wherein the cover has rounded support surfaces, but it is installed from the underside of the frame and thus cannot be easily removed. The configurations of the support housings in the frame are also complex and thus difficult to cast.

SUMMARY OF THE INVENTION

This invention overcomes the drawbacks and disadvantages of the prior art described above by providing a hinged manhole assembly construction wherein the cover cannot be detached from the frame by water surges from below, the cover will correctly reseat itself under its own weight if it is opened by such a surge, the hinge cannot be jammed or wedged by the application of an off center force, the cover can stand alone in a stable, open position, and the cover can be easily separated from the frame without resort to any specially adapted tools or equipment.

To implement these features in accordance with the invention, the manhole cover is provided with a T-shaped hinge lug which extends radially outwardly from one side of the cover and which is removably disposed within a matingly configured receptacle defined in an upper edge of the surrounding frame. The frame receptacle has a radially innermost neck portion, and a transverse trough of greater depth for receiving a unitary pivot shaft of the hinge lug. The ends of the trough are overhung by retaining lips to prevent the vertical disengagement of the pivot shaft upon a thrust or surge from the underside of the cover, and the cylindrical shaft has a flattened upper surface to enable the removal of the cover from the frame when it is pivoted to a vertical position. The hinge lug and frame receptacle are non-contacting when the cover is closed and are thus non-load bearing, which avoids any bothersome rocking or clanking noises upon the passage of a vehicle.

DETAILED DESCRIPTION OF THE PREFERRED EMBODIMENTS

Figure 1:
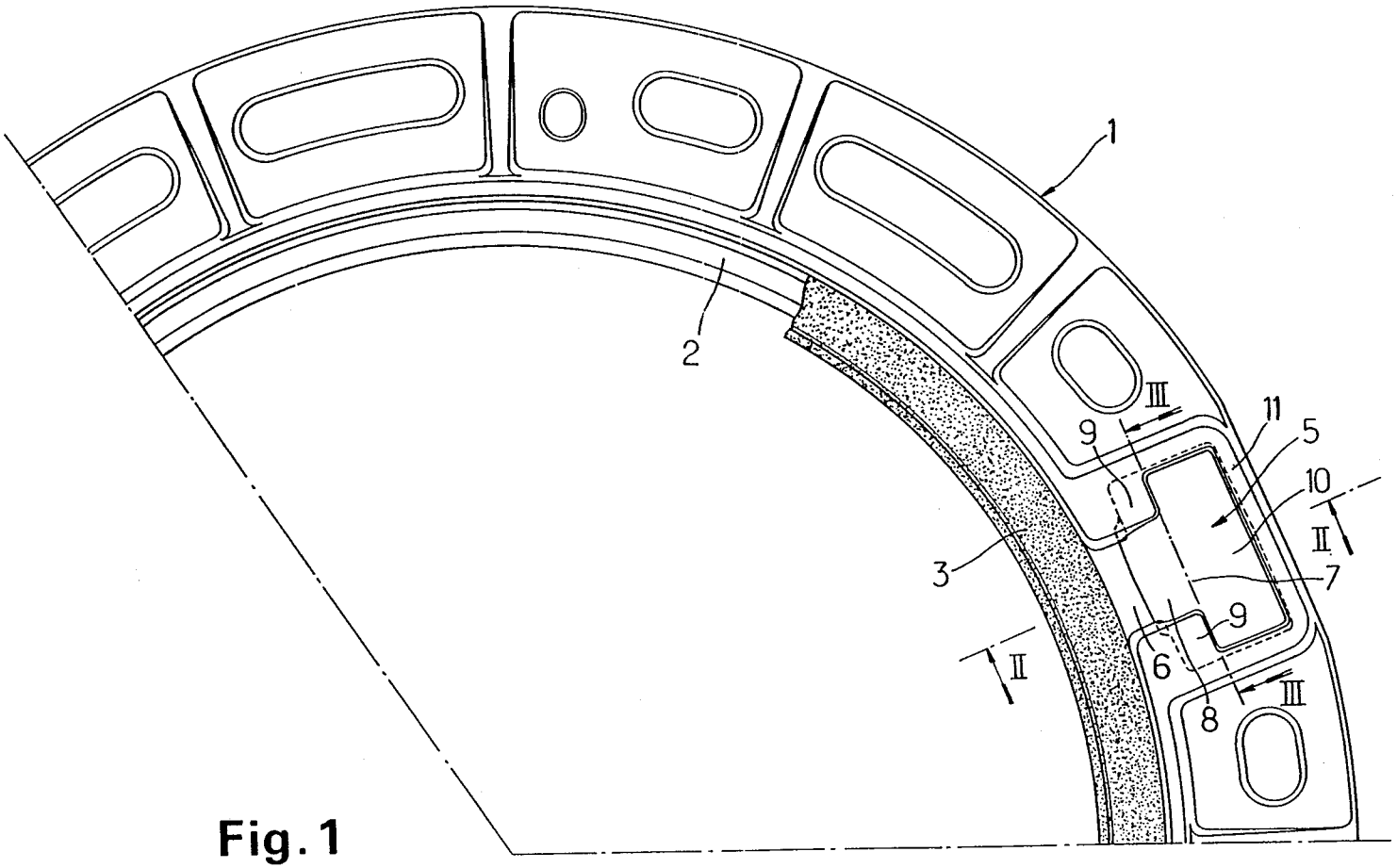
FIG. 1 is a plan view of a manhole frame in accordance with the invention.
Figure 2:
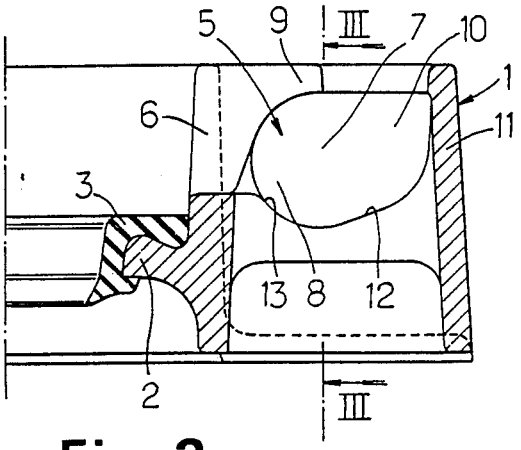
FIG. 2 is a radial section taken along line II—II of FIG. 1.
Figure 3:
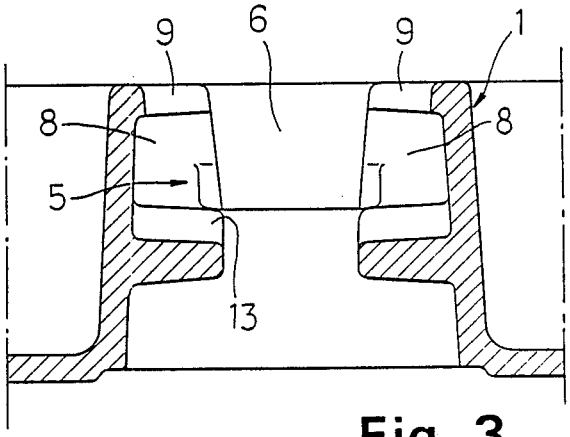
FIG. 3 is a circumferential section taken along line III—III of FIGS. 1 and 2.

Referring to FIGS. 1–3, reference numeral 1 designates a circular manhole frame adapted to be installed in a roadway or the like having an interior annular lip 2 capped by a soundproofing elastomeric gasket 3 for supporting a circular plug or cover in the usual manner.

In accordance with the invention a T-shaped hinge lug housing or receptacle 5 is defined within the frame, such receptacle being open from above and towards the frame interior. The receptacle comprises a radial neck 6 and a transverse recess or trough 7 having a depth greater than that of the neck. The trough has a radially innermost region 8 adjacent the neck 6 having a semicircular outline as best seen in FIG. 2, and a radially outermost region 10 which has an upwardly sloping bottom surface 12 which merges with an external wall 11 of the frame. The outermost region 10 of the trough is open from above, while the ends of the innermost region 8 are overhung by lips 9. The central, open portion of the region 8 spans an arc of about 90°, while the ends thereof, flanked by surfaces 13 from below and by the undersides of the lips from above, extend over approximately 180°.

Figure 5:
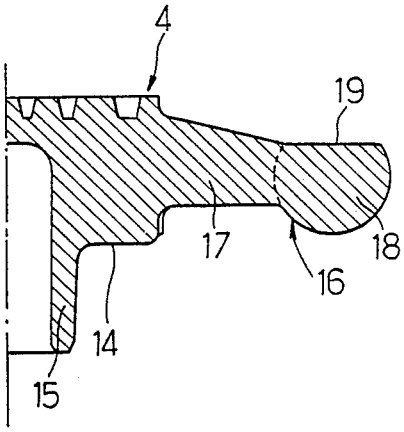
FIG. 5 is a radial section taken along line V—V of FIG. 4, FIGS. 6, 7 and 8 are radial sections showing the assembled cover and frame in three different positions of the cover.
Figure 4:
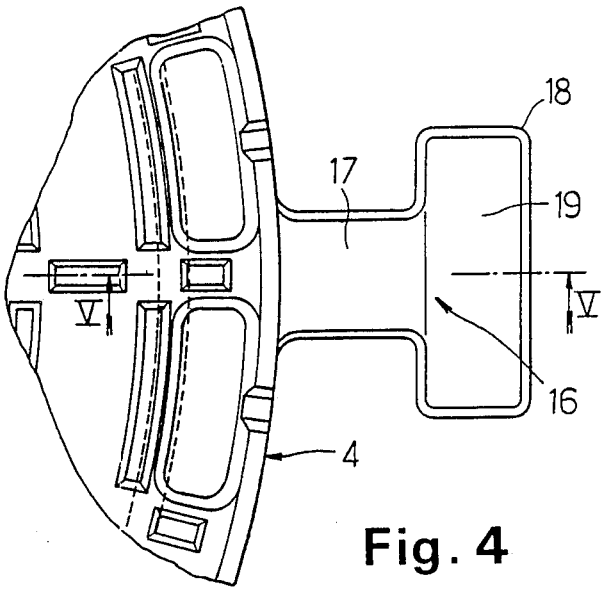
FIG. 4 is a plan view of a manhole cover in accordance with the invention, showing the radial hinge lug adapted to cooperate with the frame receptacle therefor illustrated in FIGS. 1–3.

Referring to FIGS. 4 and 5, the circular manhole cover 4 dimensioned and configured to mate with and seat within the frame, has an annular peripheral support surface 14 which rests on the frame lip 2 via the gasket 3, and an annular, downwardly extending skirt 15 to restrict the radial movement of the installed cover.

Figure 8:
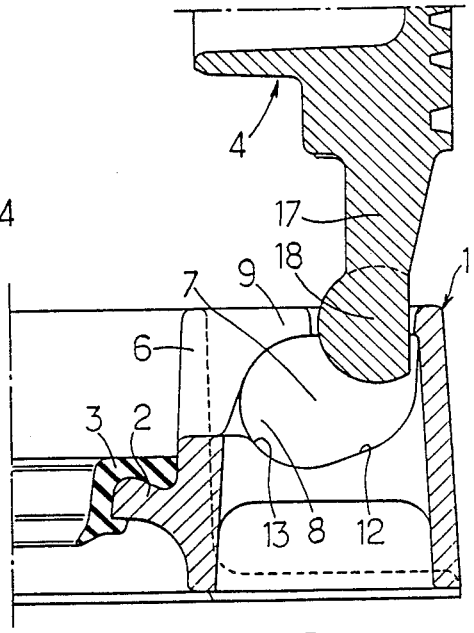

A T-shaped hinge lug or shoe 16 cooperable with the frame receptacle 5 extends radially outwardly from the periphery of the cover, and includes a neck 17 and a transverse pivot shaft 18 of generally cylindrical cross-section with a diameter slightly less than that of the trough region 8 and a flattened upper surface 19. The maximum "diameter" of the shaft 18 measured perpendicular to the surface 19 is slightly less than the width of the upper openings at the ends of the trough 7 between the lips 9 and the external frame wall 11 (as shown in FIG. 8), and the length of the shaft 18 is slightly less than that of the trough to enable the free pivoting of the installed cover while preventing any skewed wedging of the hinge lug 16 in the frame receptacle 5 when the cover is raised or lowered.

Figure 6:
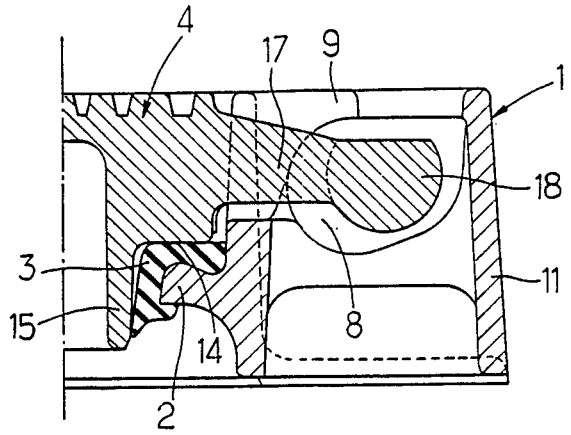

FIGS. 6 through 9 show the cover and frame assembled, with the cover being disposed in different rotational positions. As seen in FIG. 6, when the cover is closed the hinge lug 16 lies out of engagement with any of the walls or surfaces of the frame receptacle 5, and the ends of the pivot shaft 18 partially underlie the overhanging receptacle lips 9. This avoids any clanking noise during the passage of vehicles, and prevents the lug from being vertically lifted out of the receptacle.

Figure 7:
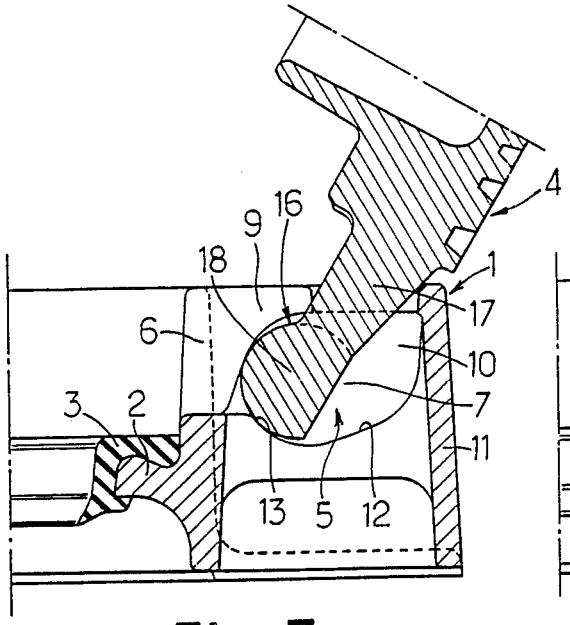
Figure 9:
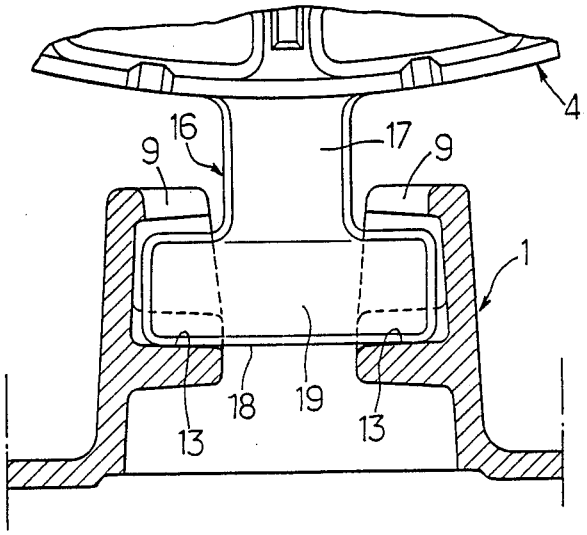
FIG. 9 is a partial elevation of the assembly showing the cover in a vertical position.

When the cover is rotatably lifted from a point diametrically opposite the hinge lug, the shaft 18 swings downwardly into engagement with the sloping bottom surface 12 of the receptacle, from which it slides downwardly until its ends are supported solely by the surfaces 13 as seen in FIG. 9. When the cover is rotated to a vertical position it may be removed as shown in FIG. 8. If it is rotated further to an angle of 15°–20° to the vertical, a stable rest position is reached with the lug neck 17 bearing against the upper edge of the frame wall 11 and the ends of the pivot shaft 18 engaging the undersides of the lips 9 as seen in FIG. 7.

Figure 10:
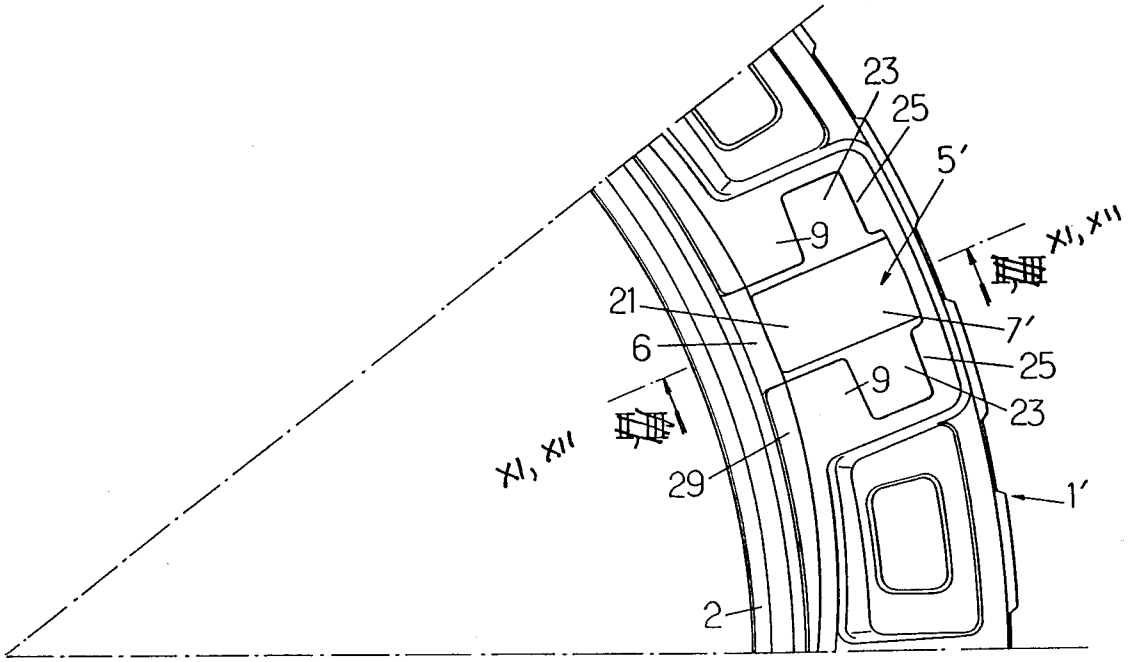
FIG. 10 is a plan view of the frame showing an alternate construction of the hinge lug receptacle.
Figure 11:
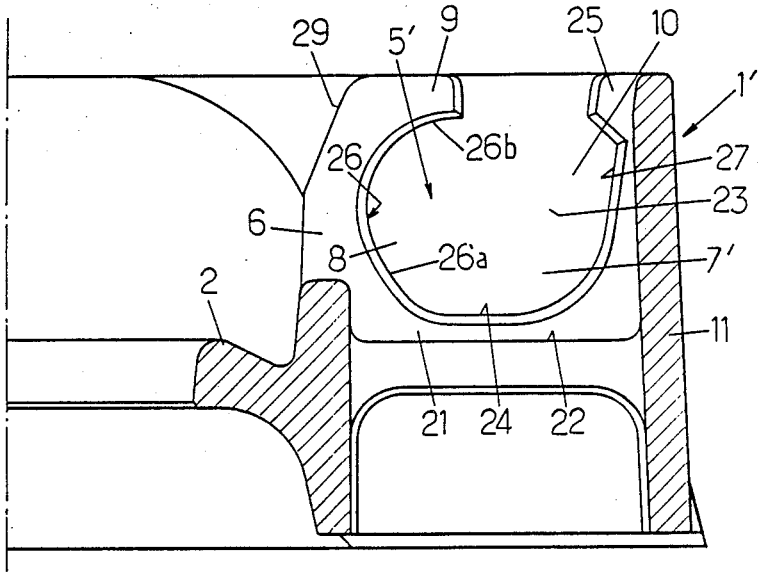
FIGS. 11 and 12 are radial sections taken along lines XI—XI and XII—XII of FIG. 10 illustrating alternate internal configurations of the lug receptacle.
Figure 12:
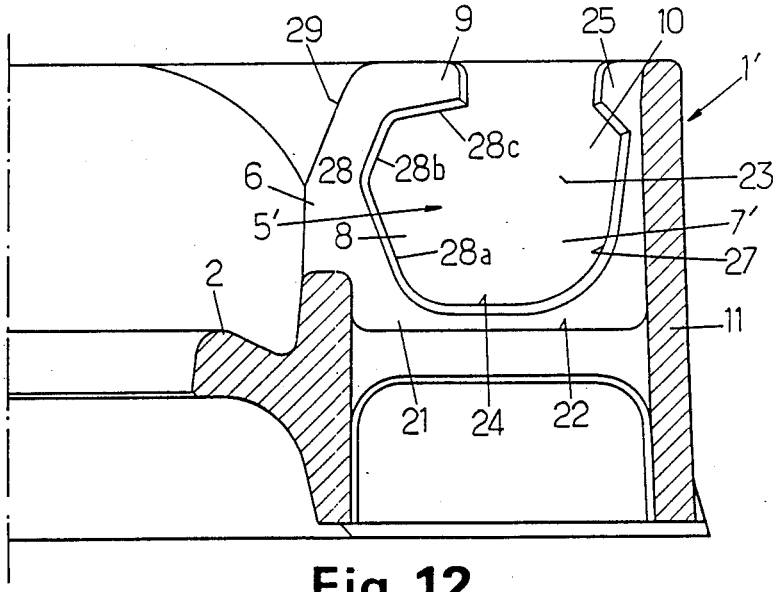

Referring to the alternate embodiments shown in FIGS. 10 through 12, wherein the primed reference numerals designate components and features differing only slightly from their counterparts in FIGS. 1–9, the trough 7' is here configured to include a central region 21 extending radially from the receptacle neck 6 to the external wall 11 of the frame 1' and having a flat, horizontal base 22, and two lateral areas 23 flanking the central area. Each lateral area has a base 24 disposed at a level higher than that of the base 22 of the central area. As before, the two lateral areas 23 serve as housings for the ends of the pivot shaft 18 of the hinge lug, and each contains a radially innermost region 8 overhung by the lips 9, and an outer region 10. Instead of being completely open from above, however, the outer region 10 is slightly overhung by lips 25 disposed opposite the lips 9.

FIG. 11 shows a first configuration of the trough 7', wherein the region 8 is defined by a concave wall 26 continuously curving from the bottom 24 of the trough to the underside of the lip 9. The lower portion **26*a* of the wall 26 has a larger radius of curvature than the upper portion 26*b*. The rear wall 27 of the lateral areas 23 of the trough slopes downwardly from the lip 25 and curves smoothly into the bottom surface 24**.

In the configuration of FIG. 12 the region 8 has a polygonal shape defined by, in succession, a lower surface **28*a* forming an angle of about 111° to the bottom surface 24, an intermediate surface 28*b* angled at about 135° to the surface 28*a*, and an upper surface 28*c* angled at about 10° to the horizontal and forming the underside of the lips 9**.

The trough configurations of FIGS. 11 and 12 are usable with the same manhole cover and hinge lug construction described above, but during opening and closing the pivot shaft 18 is only supported at its opposite ends within the lateral areas 23 of the trough 7' rather than on the sloping surface 12 as in the first embodiment. To enable the rotation of the cover without any skewed wedging of the hinge lug, a chamfer 29 having a slope of approximately 45° to the vertical (and thus substantially parallel to the intermediate surface **28*b* in FIG. 12) is provided on the upper interior edge of the frame 1' flanking the receptacle neck 6**.

What is claimed is:

1. A manhole assembly, comprising:

(a) a generally circular frame (1, 1'), (b) a generally circular cover (4) seated within the frame and removably hinged thereto by pivot means comprising:

(c) a T-shaped hinge lug (16) extending radially outwardly from a peripheral edge of the cover and defined by a radial neck (17) and a cylindrical pivot shaft (18) transverse to the neck and having a flattened upper surface (19), and (d) a T-shaped receptacle (5, 5') recessed in an upper edge of the frame, configured to receivingly accommodate the hinge lug, and defined by a radial neck (6) extending outwardly from an inner edge of the frame, a transverse trough (7, 7') having a greater depth than the receptacle neck, and a pair of retaining lips (9) individually overhanging opposite ends of a radially innermost region (8) of the trough such that said lips are disposed at opposite sides of said radial neck, wherein:

(e) said innermost region of the trough has an inwardly facing concave shape of greater diameter than a maximum diameter of the pivot shaft taken parallel to the flattened upper surface thereof, (f) inner edges of the lips define openings in cooperation with an external wall (11) of the frame above opposite ends of the trough and above a radially outermost region (10) thereof.

(g) a maximum diameter of the pivot shaft taken perpendicular to the flattened upper surface thereof is less than the width of said openings to enable the removal of the cover from the frame when the cover is raised to a vertical position, and (h) the hinge lug lies out of engagement with surfaces of the receptacle when the cover is closed to avoid metallic rocking and clanking noises upon the passage of a vehicle.

2. A manhole assembly as defined in claim 1, wherein the innermost region of the trough spans a circular arc of about 90° at a median zone thereof opposite the receptacle neck and spans an arc of about 180° at end zones thereof below the lips, wherein the radially outermost region of the trough has a lesser depth than that of said innermost region, and wherein a bottom surface (12) of said outermost region slopes downwardly to a lower surface (13) of said innermost region.

3. A manhole assembly as defined in claim 1, wherein the pivot shaft (18) of the hinge lug is supported on the bottom and lower surfaces (12, 13) of the respective outermost and innermost regions of the trough when the cover is raised.

4. A manhole assembly as defined in claim 1, wherein the axial length of the pivot shaft is only slightly less than that of the, trough to prevent any wedging or jamming of the hinge lug during the raising and lowering of the cover due to the application of an off-center force.

5. A manhole assembly as defined in claim 1, wherein an upper surface of the hinge lug neck bears against an upper edge of the external frame wall when the cover is rotated about 105° to 110° from its closed position, whereat a bottom surface of the pivot shaft bears against undersides of the retaining lips to thereby brace the cover in a stable, open position.

6. A manhole assembly as defined in claim 1, wherein the trough (7') includes a central zone (21) extending from the receptacle neck and having a flat, horizontal bottom (22), and two lateral zones (23) flanking the central zone and each having a flat, horizontal bottom surface (24).

7. A manhole assembly as defined in claim 6, further comprising an additional pair of retaining lips (25) individually partially overhanging opposite ends of the radially outermost region (10) of the trough.

8. A manhole assembly as defined in claim 7, wherein each lateral zone, in the radially innermost region (8) of the trough, has a polygonal shape extending over about 180°.

9. A manhole assembly as defined in claim 8, wherein said polygonal shape comprises a lower surface (**28*a*) angled at 111° from the horizontal bottom surface (24), an intermediate surface (28*b*) angled at about 135° from the lower surface, and an upper surface (28*c***) angled at about 10° below the horizontal and forming the underside of a retaining lip.

10. A manhole assembly as defined in claim 6, wherein an upper, inner edge of the frame is chamfered (29) on each side of the neck at an angle of about 45°.

11. A manhole assembly as defined in claim 1, wherein the frame has an annular inner lip (2) on which the cover is seated with an elastomeric gasket (3) being interposed between said frame lip and the cover.

12. A manhole assembly as defined in claim 11, wherein said elastomeric seal is L-shaped having a horizontal portion and a substantially vertical portion interposed between said frame lip and the cover.

* * * * *